US010450756B2

(12) United States Patent
Owens

(10) Patent No.: US 10,450,756 B2
(45) Date of Patent: Oct. 22, 2019

(54) SPECIAL WATER DIVERTER DEVICE FOR GUTTERS AT WALL ABUTMENTS

(71) Applicant: Daniel Owens, Martinsville, IN (US)

(72) Inventor: Daniel Owens, Martinsville, IN (US)

( * ) Notice: Subject to any disclaimer, the term of this patent is extended or adjusted under 35 U.S.C. 154(b) by 0 days.

(21) Appl. No.: 16/117,204

(22) Filed: Aug. 30, 2018

(65) Prior Publication Data

US 2019/0063069 A1 Feb. 28, 2019

Related U.S. Application Data

(60) Provisional application No. 62/552,823, filed on Aug. 31, 2017.

(51) Int. Cl.
*E04D 13/04* (2006.01)
*E04D 13/064* (2006.01)

(52) U.S. Cl.
CPC ..... *E04D 13/0481* (2013.01); *E04D 13/0459* (2013.01); *E04D 13/064* (2013.01); *E04D 13/0641* (2013.01); *E04D 2013/0486* (2013.01)

(58) Field of Classification Search
CPC ..... E04D 13/0481; E04D 13/0459; E04D 13/064; E04D 2013/0486
USPC ..... 52/212
See application file for complete search history.

(56) References Cited

U.S. PATENT DOCUMENTS 3,266,207 A 8/1966 Birum
5,109,641 A 5/1992 Halan
D343,825 S * 2/1994 Enderby ..... D13/152
5,287,665 A 2/1994 Rath, Jr.
5,326,060 A * 7/1994 Chubb ..... F21V 21/02 174/503
5,388,377 A 2/1995 Faulkner
5,722,208 A * 3/1998 Humphrey ..... F21S 8/033 174/502
5,775,032 A * 7/1998 Lacy ..... F21V 21/02 174/502
5,918,431 A * 7/1999 Schiedegger ..... E04C 1/392 248/56
6,268,563 B1 * 7/2001 Gretz ..... H02G 3/14 174/53
6,481,164 B1 12/2002 McCorckel
7,005,578 B2 * 2/2006 Gretz ..... H02G 3/123 174/50

(Continued)

FOREIGN PATENT DOCUMENTS

WO WO-9105922 A1 * 5/1991 ..... E04D 13/0459

*Primary Examiner* — Adriana Figueroa
(74) *Attorney, Agent, or Firm* — Ritchison Law Offices, PC; John D Ritchison

(57) ABSTRACT

This is a uniquely designed water diverter device for gutters at wall abutments. The device secures the gutter and provides a seal for preventing water to leak and ooze behind the siding. Thus it prevents rainwater from seeping behind siding or under roofing material, yet at the same time does not allow the buildup of debris which can create a back-up of water or allow the formation of ice dams to exacerbate a back-up of water. The diverter device includes a base structure with a top, bottom, closed end, open end, and a raised rim section extending from a plate with a gutter side and wall side; a cover section; a manner to hold the cover to rim of base; and an adhesive, seal, and fasteners to hold wall face plate of base structure to the face of a wall abutment.

15 Claims, 9 Drawing Sheets

(56) References Cited

U.S. PATENT DOCUMENTS

Figure 1A:
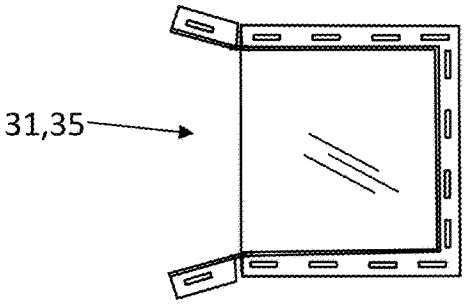
Figure 1B:
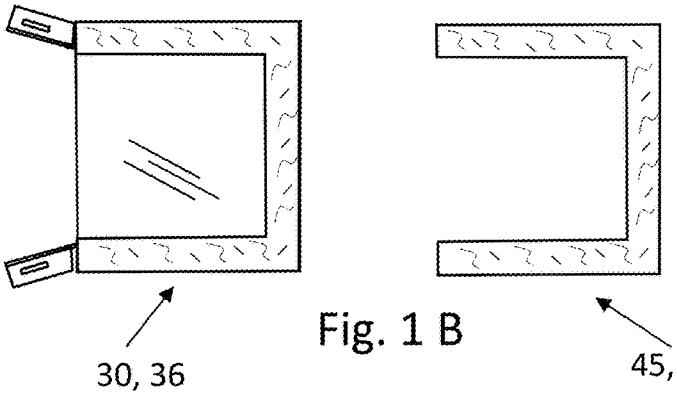
Figure 1C:
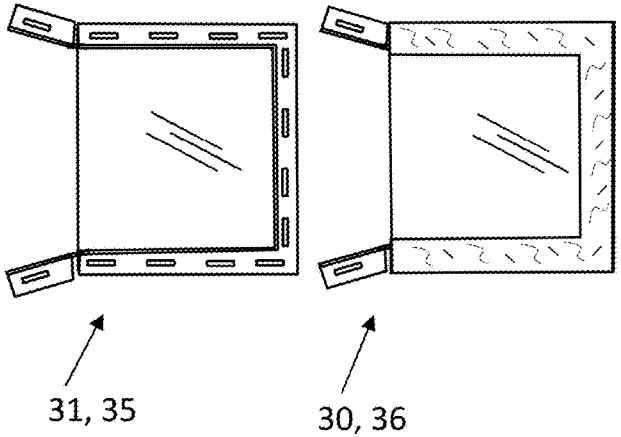
Figure 1D:
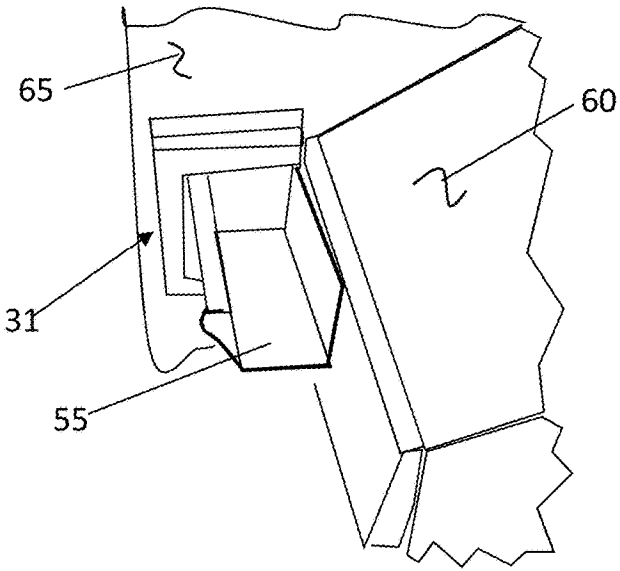

| | | | | |
|---|---|---|---|---|
| 7,064,271 | B1 * | 6/2006 | Gretz | H02G 3/123 174/53 |
| 7,685,799 | B2 | 3/2010 | Nelson | |
| 8,152,013 | B2 * | 4/2012 | Hendricks | F24F 13/082 174/562 |
| 8,572,910 | B2 * | 11/2013 | Hendricks | F24F 13/082 174/50 |
| 9,637,927 | B2 * | 5/2017 | Pendley | E04D 3/352 |
| 2003/0046888 | A1 | 3/2003 | Ryan | |
| 2003/0131542 | A1 | 7/2003 | Coblentz | |

* cited by examiner

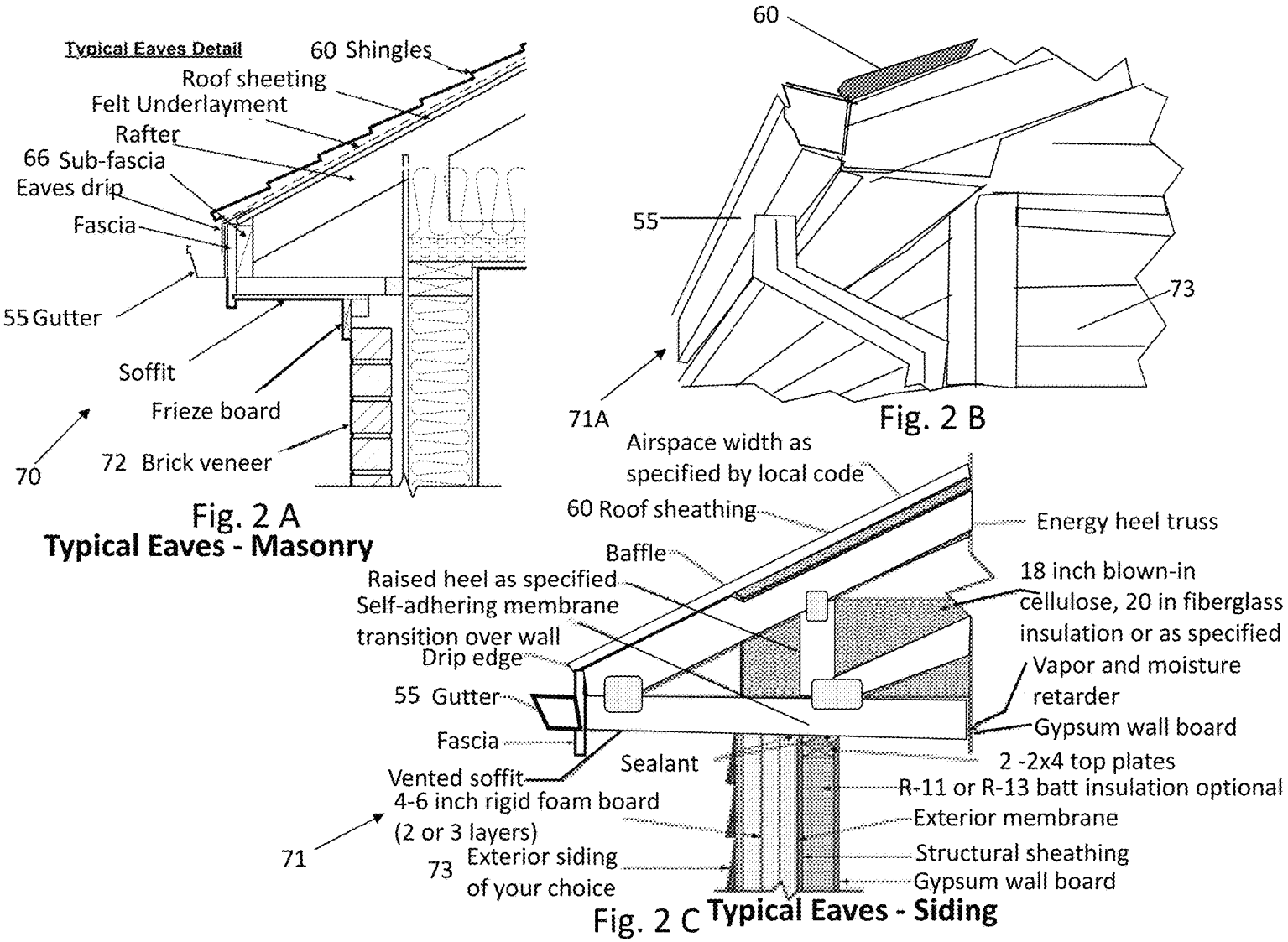
Typical Eaves Detail
60 Shingles
Roof sheeting
Felt Underlayment
Rafter
66 Sub-fascia
Eaves drip
Fascia
55 Gutter
Soffit
Frieze board
72 Brick veneer
70
Fig. 2 A
Typical Eaves - Masonry
60
55
73
71A
Fig. 2 B
Energy heel truss
18 inch blown-in cellulose, 20 in fiberglass insulation or as specified
Vapor and moisture retarder
Gypsum wall board
2 -2x4 top plates
R-11 or R-13 batt insulation optional
Exterior membrane
Structural sheathing
Gypsum wall board
Airspace width as specified by local code
60 Roof sheathing
Baffle
Raised heel as specified
Self-adhering membrane
transition over wall
Drip edge
55 Gutter
Fascia
Sealant
Vented soffit
4-6 inch rigid foam board
(2 or 3 layers)
73 Exterior siding
of your choice
71
Fig. 2 C
Typical Eaves - Siding

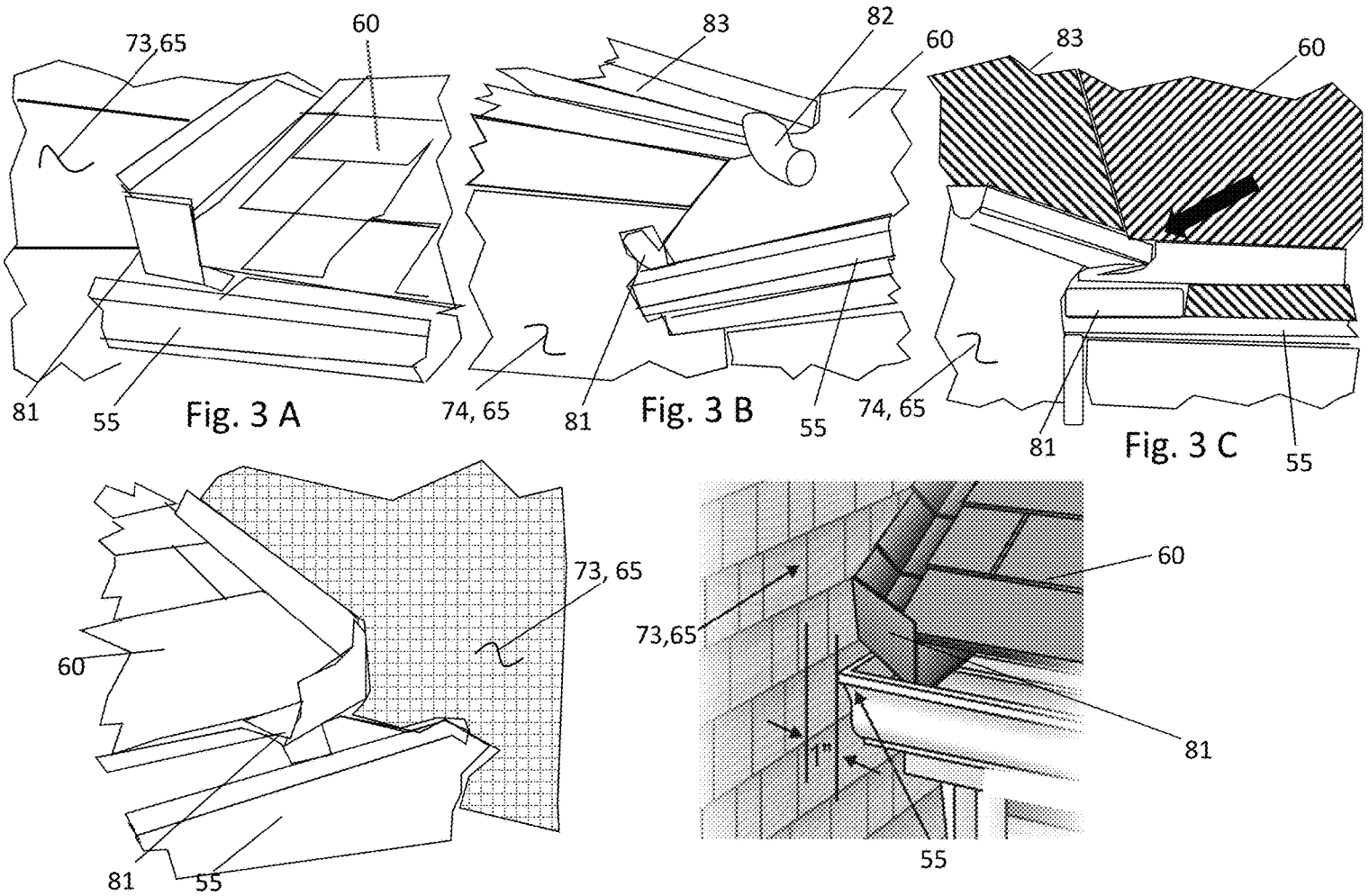
The Problem 31, 35
47
49
48
41
42

45, 46
49A
47A
48A
OPEN
31

50
44
37
40
39
44
41
42
38
30, 36
39
50
41

OPEN
47
48
49
46

47A
48A
46

OPEN
47A
48A
49A
46

41
44
43,51
36

43
39
37
56
50
46
36

41
44
38
50
39
42
44
37
56
50
50
36

Replacement Sheet
6 / 9
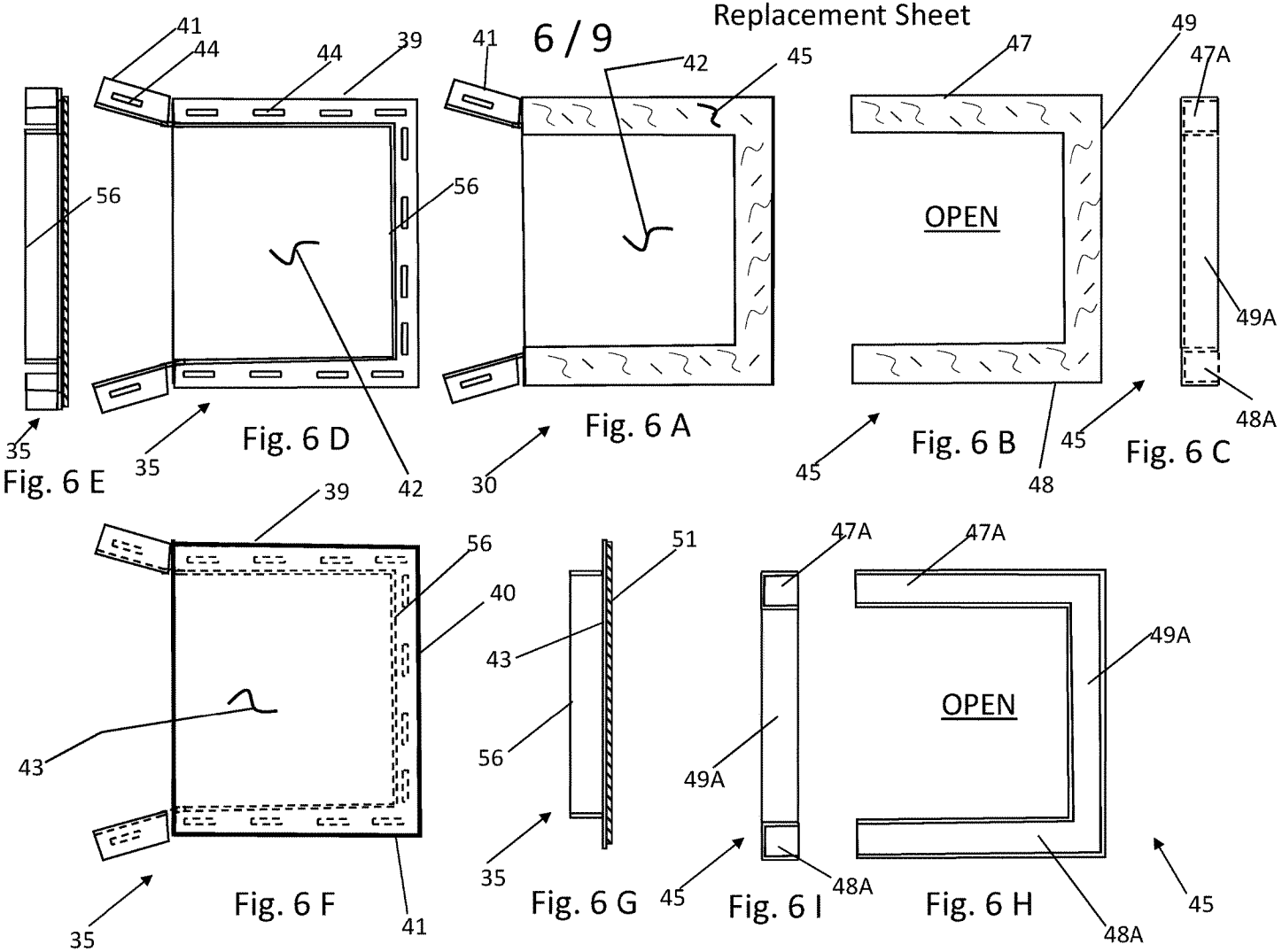

OPEN
54
42
54
42
53
53
35
30
45
35
41
56
43
51
52
43

Sketches option siding/ back sides 60
66
55
46
65
36
44
31

Operation

US 5,287,665

US 2003/0131542

US 7,685,779

Prior Art – US
5,109,641

SPECIAL WATER DIVERTER DEVICE FOR GUTTERS AT WALL ABUTMENTS

CROSS-REFERENCE TO RELATED APPLICATIONS

This application claims the benefit of U.S. Provisional Patent Application with Ser. No. 62/552,823 filed Aug. 31, 2017, by Daniel Owens and entitled "Special water diverter device for gutters at wall abutments".

FIELD OF INVENTION

This invention relates to a special water diverter device for gutters at wall abutments. This invention relates to a gutter assembly for roofs and more particularly to a gutter or eaves trough assembly. The device relates generally to siding placed on a house, and more specifically to diverting rainwater from the juncture of a sloped roof and vertical wall siding. This is related to a two-piece device that encircles the gutter and helps prevent water intrusion behind a wall. It is for use at a juncture between a vertical wall and an edge of a sloped roof, to prevent water from seeping behind siding.

FEDERALLY SPONSORED RESEARCH

None.

SEQUENCE LISTING OR PROGRAM

None.

BACKGROUND-FIELD OF INVENTION AND PRIOR ART

As far as known, there are no special water diverter devices for gutters at wall abutments or the like. It is believed that this product is unique in its design and technologies utilized to solve gutter leakage at wall abutments.

Background

Heretofore, various types of mountings have been provided for mounting gutters beneath a shingled roof. Hangers for supported gutters are normally cantilevered outwardly from the fascia board and are usually secured to the fascia board by gutter spikes, nails or screws. The nails, screws or gutter spikes oftentimes tend to pull away from the fascia board after extended use, particularly during heavy rain downpours or when downspouts are blocked. Also, at times the fascia board tends to pull away from a rafter or header board to which it is attached under such conditions resulting from the cantilevered weight of the gutters extending outwardly from the fascia board. Of particular concerns are the gutter mountings at wall abutments. The seal with the surrounding siding or masonry is usually surface mounted and offers appoint of water intrusion as the gutters and wall covers settle and age. Siding is often used to protect the outside of the house. Such siding is generally made of aluminum or vinyl material and is attached along the outside face of a house. At the juncture of a sloped roof where it abuts a portion of a vertical wall, there is ordinarily a flashing used to cover the juncture to prevent water from leaking down through the juncture where the vertical wall meets the sloped roof. The flashing generally comprises a wall flange which is mostly hidden from view beneath the siding and a roof flange which is mostly hidden from view by the roof covering. The two flanges, generally made of a single strip of waterproof material and bent along its length at approximately a right angle, are purposely made leak proof to prevent rainwater from getting into the line of abutment between the roof and wall. Often referred to as a step gable or wall flashing, such flashing generally comprises a series of flashing members arranged in stepped manner, each lower member inserted an effective distance beneath the next higher member in the same manner that roofing shingles or tiles are positioned. This provides cascading of the water as it flows from one overlapping portion, in turn, to the next lower, overlapped portion. The overlapping flashing arrangement terminates at the roof edge. Water can flow behind the vertical wall abutting this termination point unless the water is diverted away. At the point where the vertical wall and the edge of the sloped roof coincide, the flashing abuts the siding on the vertical wall. Additional steps are required at this point to prevent water from running off the flashing, seeping behind the siding and causing damage to the underlying structure.

Typically, such flashing is made of a metal material and is comprised of two planar sections. The planar sections are disposed at some angle relative to each other, resulting in an L-shaped flashing. One section is positioned under the siding and affixed to the vertical wall, and the other section is positioned under the shingles and affixed to the sloped roof. This type of flashing is normally placed along the entire seam created by the juncture. At the point where the vertical wall and the edge of the sloped roof coincide, however, the flashing is disposed abutting the siding on the vertical wall. Additional sealing is required at this point to prevent water from running off of the flashing, seeping behind the siding and causing damage to the underlying structure. This sealing is usually roof cement or caulking and is applied to the flashing and the siding. The problem with such a method is that due to shrinkage of the caulk over time, thermal expansion and contraction of the dissimilar materials, and weathering, the seal fails and water seeps behind the siding.

Prior Art

A novelty search was performed which showed no similar prior art that anticipates the special water diverter device for gutters at wall abutments. The search of prior art revealed:

A. U.S. Patent application 2003/0046888 was submitted by Ryan in 2003. It is called a Secondary moisture drainage system for structures having pre-manufactured exterior cladding systems. This shows a secondary drainage system for buildings utilizing pre-manufactured exterior panels. The system drains off moisture and condensation collected in joints and on the rear wall of the panels, under circumstances where the primary exterior seal or cladding have failed. An elongated collection channel is attached in inclined relation to the rear wall of a panel. The channel includes a top cover, comprised of a trough having inclined walls and oval apertures. The lower end of the channel includes an end cap with a drain tube, connected to an upper, inner portion of a receptacle box. The receptacle box is located within a vertical joint between two adjacent panels. A lower, outer portion of the receptacle box has a one-way discharge valve. Also provided are intermediate joint gutters, having open tops and a discharge outlet positioned over the trough of a collection channel.

B. A U.S. Pat. No. 5,388,377 by Faulkner was issued in 1995 for a device entitled a Gutter assembly for roofs.

This demonstrates a gutter assembly for a roof including a gutter, a plurality of spaced hangers, and a leaf screen over the gutter. Lag bolts are mounted at an angle to the horizontal through aligned openings in the hangers and extend through the fascia board into a rafter or a joist. One embodiment has a removable strip for fitting on an existing gutter and having a slot to receive a leaf screen. A second embodiment provides hanger brackets on a downspout for mounting on screws secured to a support wall.

C. Another U.S. Pat. No. 3,266,207 by Birum was issued in 1966 for a device named an Exterior panel wall assembly. This invention relates to building materials and more particularly to exterior panel walls for buildings, factories, homes and the like, which is so designed as to provide completely water-tight protection.

D. A U.S. Pat. No. 6,481,164 by McCorkel was issued in 2002 for an invention entitled a Rainwater diverter. This invention is directed to a diverter and to a method that prevents rainwater from seeping behind siding or under roofing material, yet at the same time does not allow the buildup of debris creating a back-up of water or allow the formation of ice dams to create a back-up of water. In one form the present invention is installed to a vertical wall at a juncture between the vertical wall and an edge of a sloped roof to prevent water flowing along a roof-wall juncture from seeping behind siding located on the vertical wall and shingles located on the sloped roof. The invention comprises a back wall, a top wall, a bottom wall, a first side wall, and a second side wall in the form of an open sided box. The open side extends outwardly from the vertical wall to serve as an exit, with the top wall having at least one access opening. This access opening is positioned such that water flowing along a roof wall juncture enters the access opening preventing the water from seeping behind the vertical wall and shingles located on the sloped roof. Optionally, the water collected is transported away from the building by a rain gutter which terminates within the diverter. In a different embodiment the diverter has at least one drip edge.

E. A U.S. Pat. No. 5,109,641 by Halan was issued in 1992 for another device called a Roof transition flashing. Here is provided a roof transition flashing for installation to a building at a juncture between a vertical wall and an edge of a sloped roof, to prevent water flowing along the flashing from seeping behind siding that is located on the vertical wall and shingles located on the sloped roof. The roof transition flashing comprises an L-shaped member having a vertical planar section and a transverse planar section. The transverse planar section extends generally laterally from the vertical planar section and is joined thereto by a first imperforate seam. The vertical planar section is positioned under the siding and flush with the vertical wall and the transverse planar section is positioned under the shingles and flush with the sloped roof. The L-shaped member has an upper end and a relatively lower end. A deflector means sealingly cooperates with the lower end of the L-shaped member so that when the roof transition flashing is positioned with the lower end adjacent the edge of the sloped roof, the water flowing along the roof flashing toward the edge of the sloped roof will be deflected away from the vertical planar section and away from the siding, to prevent the water from seeping behind the siding.

F. U.S. Pat. No. 7,685,779 by Nelson was issued in 2010 for a Molded wall flashing kick out. Shown here is a molded wall flashing kick out that is designed to be the lower terminus end of a flashing system that is used wherein a roof section terminates against a sidewall of a building. The molded wall flashing kick out has a sheet-like body member that is bent along a longitudinal seam. A kick out plate is integrally formed on the end cap and extends outwardly from a generally vertical section of the body member toward and attaches to a generally horizontal section of the body member. A channel, which may have two sections, is formed on the body member in order to receive a vinyl siding J-channel. The outer edge of the horizontal section of the body member is curled while at least one opening is located on the vertical section of the body member in order to receive a fastener there through.

G. A U.S. Pat. No. 5,287,665 by Rath, Jr. was issued in 1994 for a device named a Waterproof flanged exterior wall outlet secured to a building framework. This is a flanged outlet, such as an electrical outlet box that is provided for installation on an exterior wall of a building. The outlet has laterally enclosing walls the interior surfaces of which define an opening there within. The opening faces outwardly away from the exterior building wall. The box has a unitary integrally formed flat flange that extends laterally from the exterior surfaces of all of the walls about the entire perimeter of the outwardly facing opening. The flange is located behind the outlet opening. The flanged outlet can be employed in conjunction with upper and lower sheets of waterproof material, such as the waterproof black paper that is used to provide a moisture barrier in conventional building construction. A lower sheet of waterproof material resides between the flange of the outlet and an outwardly facing building surface and extends downwardly from beneath the outwardly facing opening of the outlet. An upper sheet of waterproof material is fastened to the outwardly facing building surface above the outlet flange. Moisture is thereby carried down the outer surfaces of the waterproofing sheets, and cannot penetrate to the interior of the building through openings defined therein to accommodate the outlet of the invention.

H. A US Patent Application No. 2003/0131542 by Coblentz was submitted in 2003 for an invention entitled a Roof eave rain director. Here is taught a rain water diverter (transition flashing) to prevent water intrusions at eave of sloped roof and vertical wall abutments, The diverter comprises of a vertical wall flange that lies along the wall and a roof flange that lies against the sloped roof, spanning the lower portion of the roof flange is the up-turned U-shaped diverter, at an angle of preferably approximately 95 degrees or more from vertical flange. The unit has J-trim to accommodate sidings and a starter shingle slot that also serves as a stop to aid in installation.

Problem Solved

The improvement and problem solved as special water diverter device for gutters at wall abutments should be useful: (1.) The device holds the gutter and provides a seal for the siding. Thus it prevents rainwater from seeping behind siding or under roofing material, yet at the same time does not allow the buildup of debris creating a back-up of water or allow the formation of ice dams to create a back-up of water. (2.) A common problem in the construction business is that of weatherproofing structural junctures, such as that between a vertical wall and a sloped roof. Weatherproofing serves the goal of protecting the underlying structure from the damage associated with water seepage, e.g. rotting of wood, loss of insulation effectiveness and cracking of masonry, and the like. The new device provides a simple and fast way to encircle the gutter while allowing the siding and wall a better seal. (3.) There exists a need in the art for a system that allows a flashing system to have an encircling structure to hold the gutter and yet separate it from the abutting wall. Such a system must be usable in a roof deck to side wall transition area and must be usable with flashing systems made from a variety of materials.

SUMMARY OF THE INVENTION

This invention is a special water diverter device, made of durable materials, for gutters at wall abutments. The preferred embodiment of a water diverter device for gutters at wall abutments is comprised of: (a) a base structure including a top, bottom, closed end, open end, and a raised rim section extending from a plate with a gutter side and wall side; (b) a cover section with a top, a bottom, a closed end and an open end; (c) a means to hold cover to rim of base such as spring clips, adhesive, plastic tabs, or the like; and (d) an adhesive or fasteners (screws, nails, rigid drive clips, etc.) to hold wall face plate of base structure to wall abutment wherein the base structure is mounted to the wall abutment and the cove is placed and connected to the base structure which provides a sealed attached device for mounting the gutter to the fascia while also providing a seal for siding and masonry walls at the abutment.

The newly invented special water diverter device for gutters at wall abutments may be manufactured at low volumes by very simple molding systems and in high volume production by more complex and controlled injection molding systems.

Objects and Advantages

There are several objects and advantages of the special water diverter device for gutters at wall abutments. There are currently no known water diverter device for gutters at wall abutments that are effective at providing the objects of this invention.

The special water diverter device for gutters at wall abutments has various advantages and benefits as follows:

| Item | Advantages |
|---|---|
| 1 | Is fast to install |
| 2 | Has most parts and molds already available with minor re-tooling |
| 3 | Is a universal designs for attachments to fit different gutters and may be easily increased or decreased to fit the standard and seamless gutters |
| 4 | Use by siding installers, gutter installers, repair persons, and masons |
| 5 | Protects from water intrusion at vulnerable and traditionally difficult places to stop the intrusion |
| 6 | Can be distributed by large building parts suppliers as well as box stores like Lowes, Menards, Home Depot etc. |
| 7 | Yet another advantage of the present invention is that by diverting the water into a gutter positioned within the device, if ice should form, the ice will be contained within the device, thus preventing water and ice from backing up behind the siding or under the shingles. |

Finally, other advantages and additional features of the present special water diverter device for gutters at wall abutments will be more apparent from the accompanying drawings and from the full description of the device. For one skilled in the art of gutter, siding and masonry systems and devices, it is readily understood that the features shown in the examples with this product are readily adapted to other types of gutter installations at wall abutments.

DESCRIPTION OF THE DRAWINGS—FIGURES

The accompanying drawings, which are incorporated in and constitute a part of this specification, illustrate an embodiment of the special water diverter device for gutters at wall abutments that is preferred. The drawings together with the summary description given above and a detailed description given below serve to explain the principles of the special water diverter device for gutters. It is understood, however, that the device is not limited solely to only the precise arrangements and instrumentalities shown.

FIGS. 1 A through 1 D are sketches of the general water diverter for the gutters at wall abutments.

FIGS. 2 A through 2 C are sketches of the general gutters and eaves for masonry and siding applications.

FIGS. 3 A through 3 E are sketches showing the problems with gutters at the wall abutments with features shown from generally a side view.

Figures 4A, 4B, 4C:
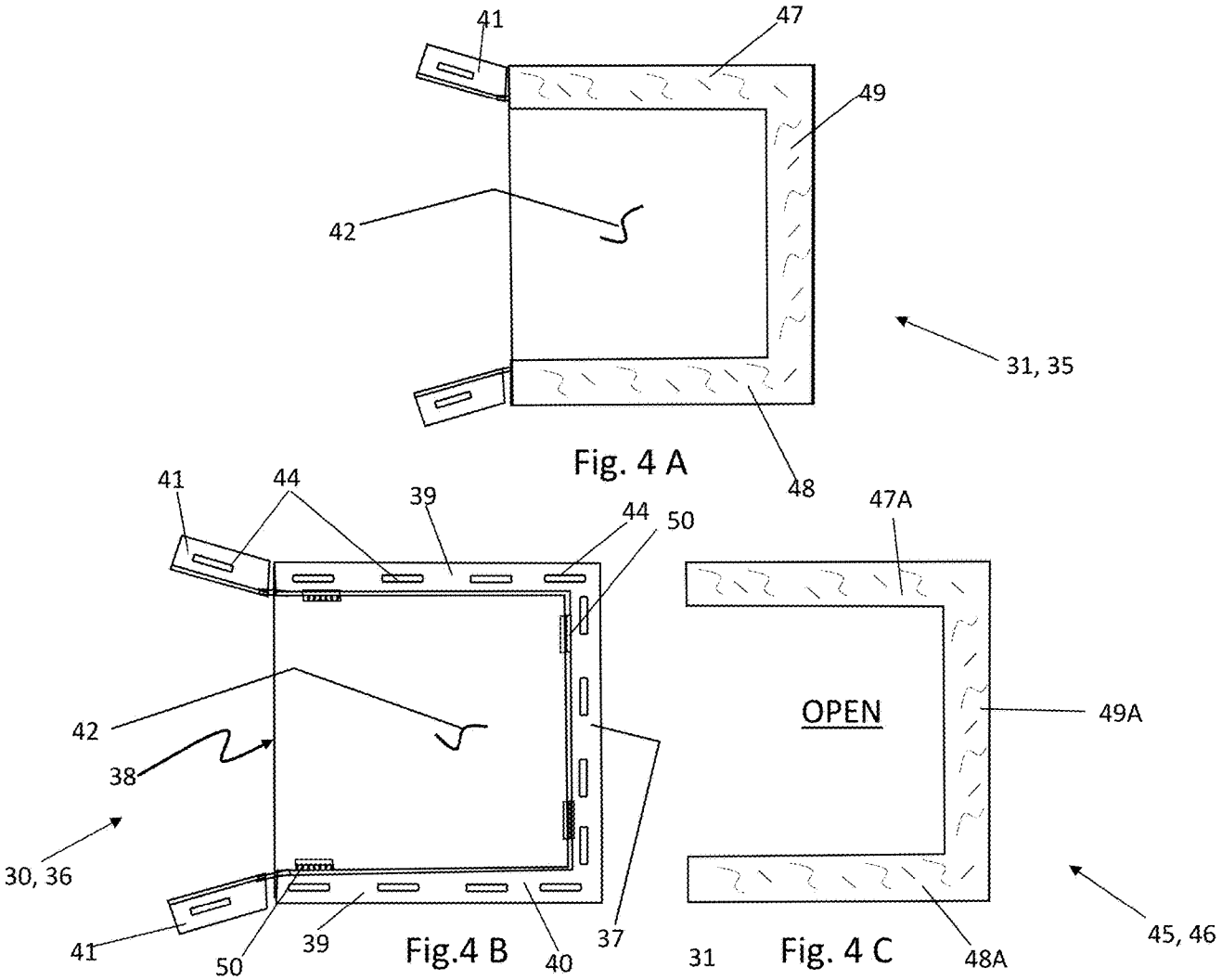

FIGS. 4 A through 4 C are sketches of the prototype water diverter, base, and cover with components shown.

Figures 5A, 5B, 5C, 5D, 5E, 5F:
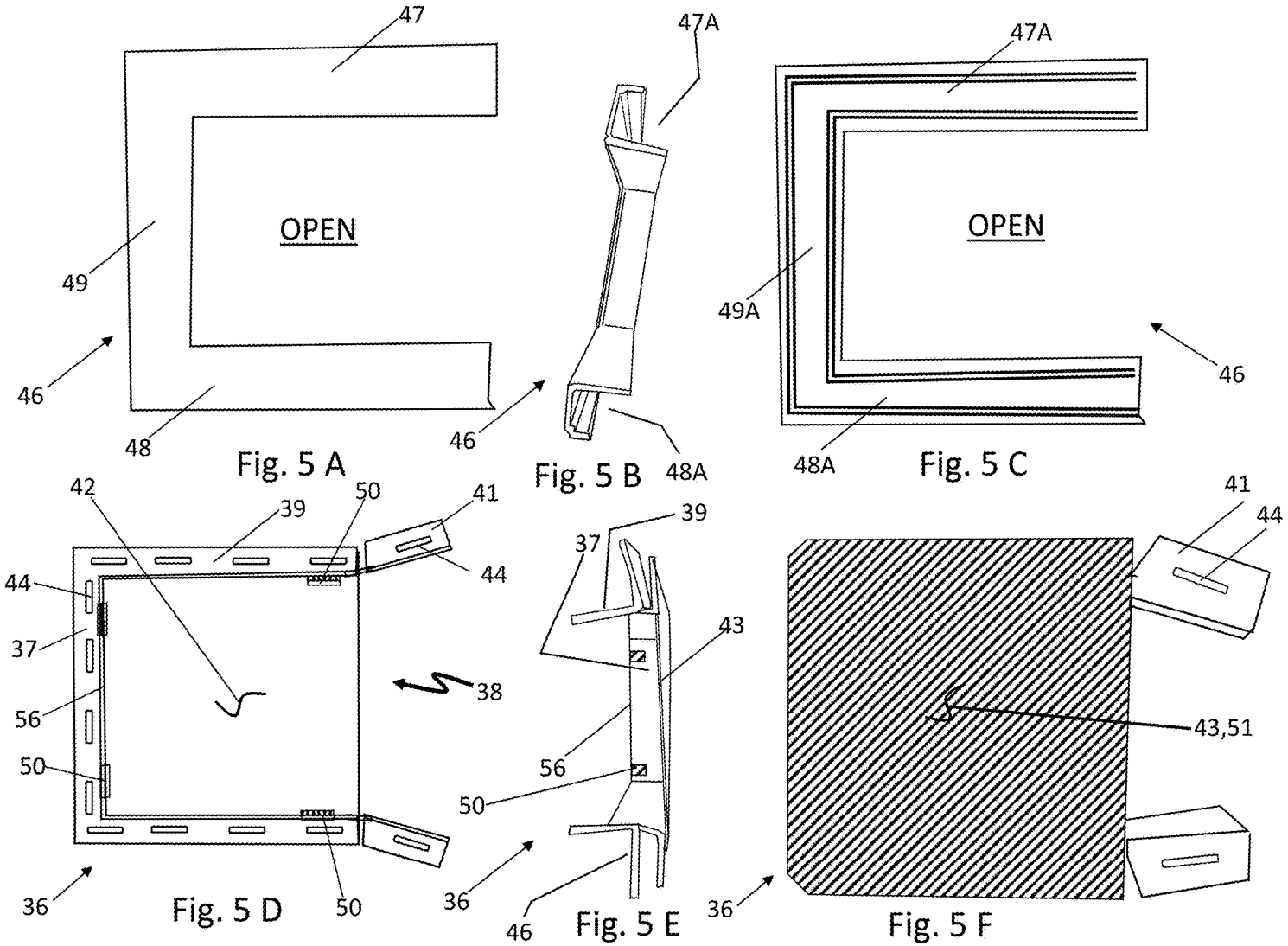

FIGS. 5 A through 5 F are sketches of the base and cover with components and features denoted.

FIGS. 6 A through 6 I are black and white sketches of the water diverter, its base and its cover with components and features shown.

Figures 7A, 7B, 7C, 7D, 7E:
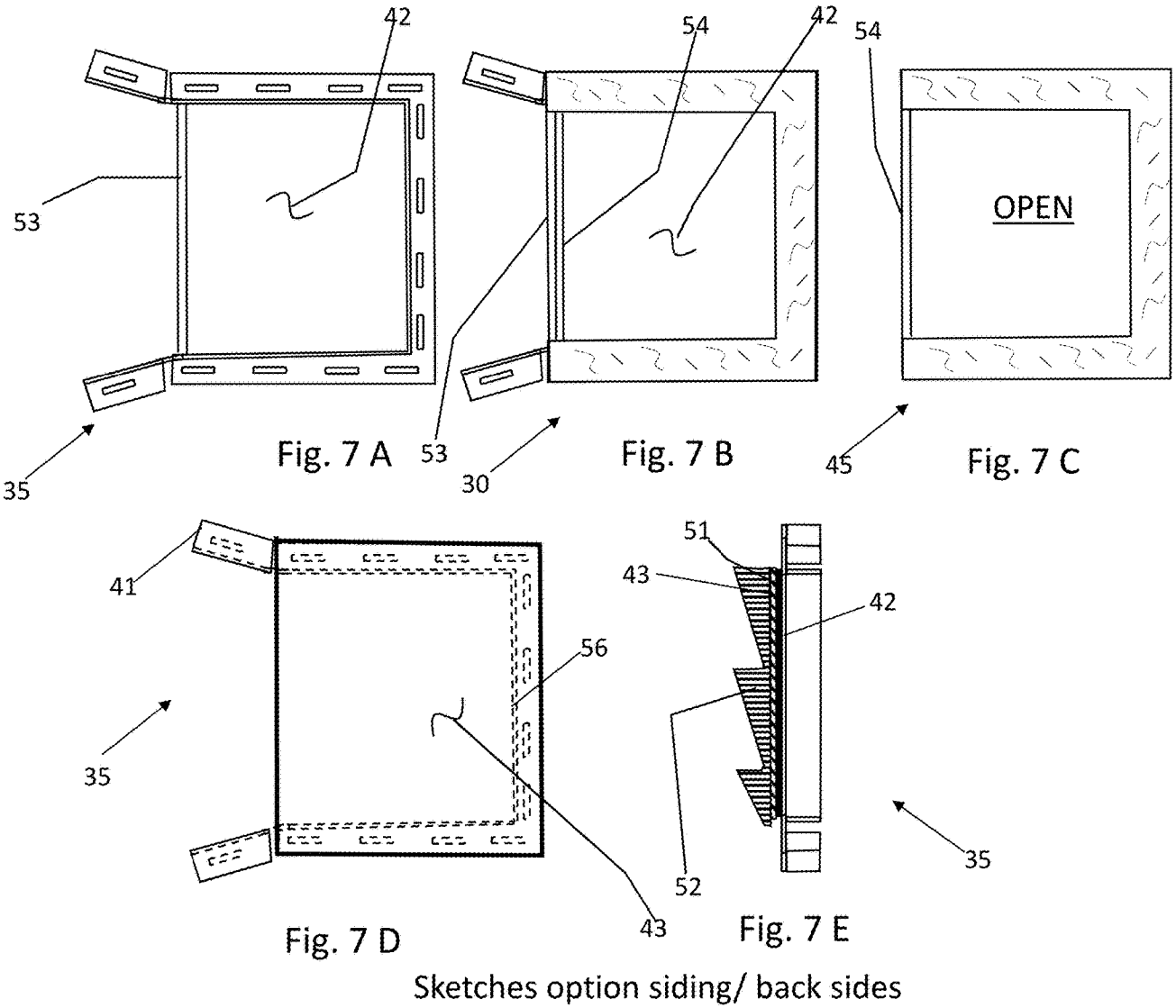

FIGS. 7 A through 7 E are sketches of options for the water diverter base.

Figures 8A, 8B, 8C, 8D, 8E:
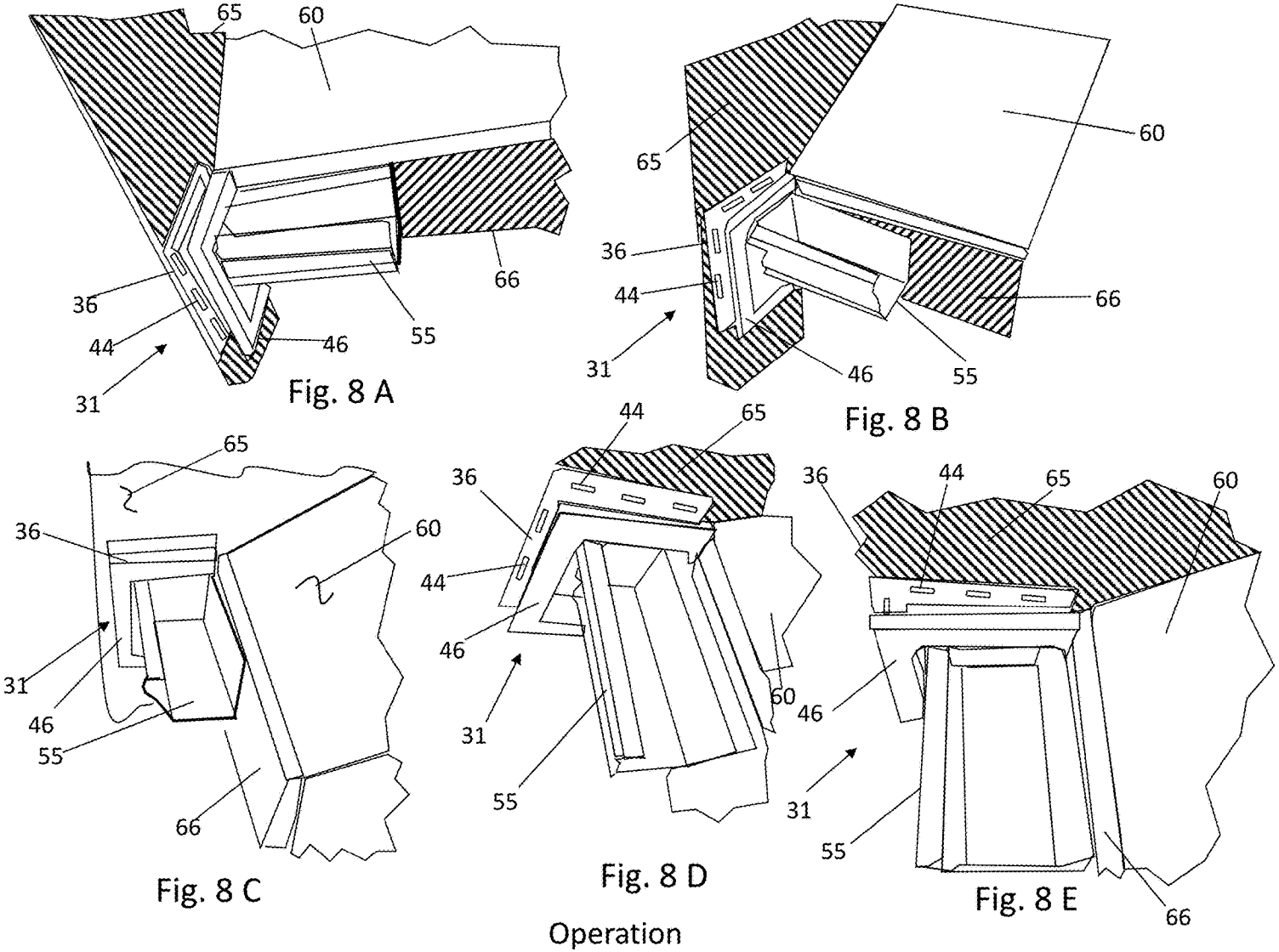
Figure 9A:
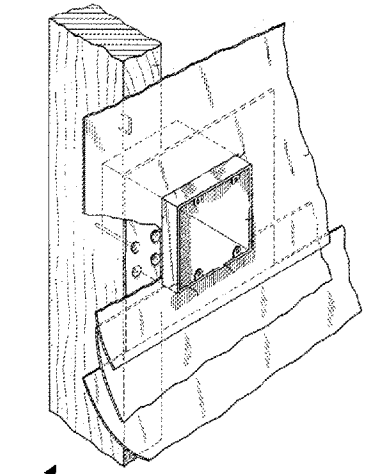
Fig. 9 A Prior Art
Figure 9B:
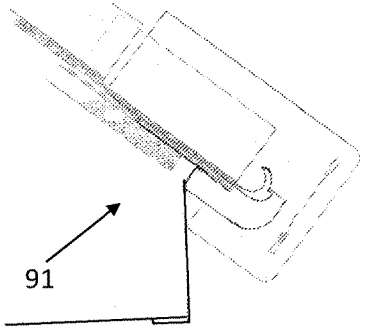
Fig. 9 B Prior Art
Figure 9C:
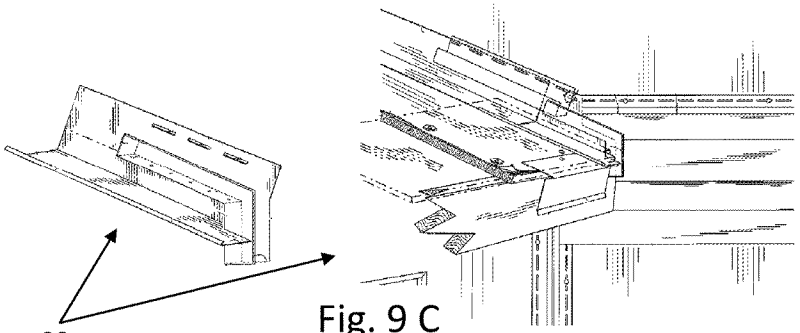
Fig. 9 C Prior Art
Figure 9D:
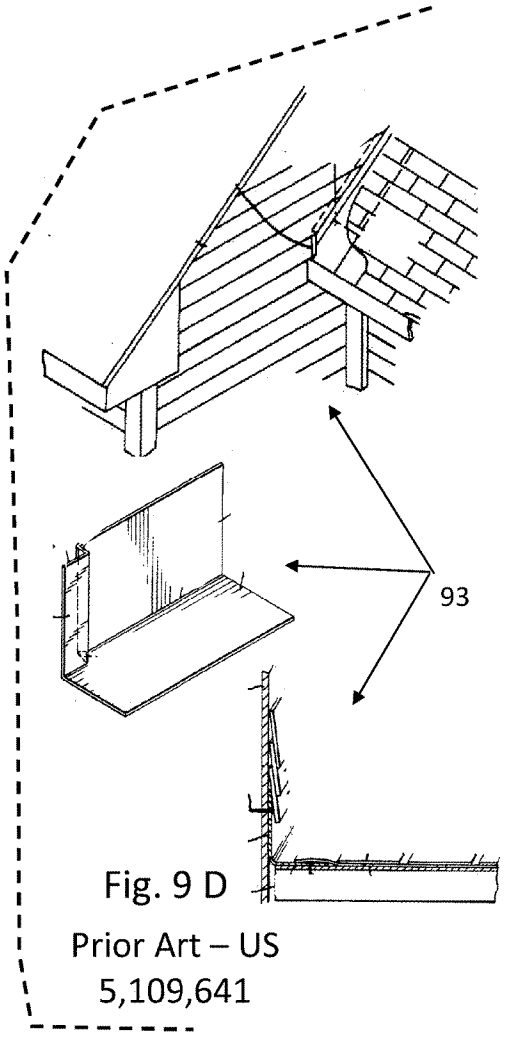

FIGS. 8 A through 8 E are sketches of the water diverter installation on a wall abutment and roof deck.

FIGS. 9 A through 9 D are sketches of the prior art attempting to divert water from roofs at wall abutments.

DESCRIPTION OF THE DRAWINGS—REFERENCE NUMERALS

The following list refers to the drawings:

TABLE B

| Reference numbers | |
|---|---|
| Ref # | Description |
| 30 | special water diverter device 30 for gutters at wall abutments 65 |
| 31 | prototype 31 water diverter 30 |
| 35 | base structure 35 of water diverter 30 |
| 36 | sketch of prototype 36 of base structure 35 |
| 37 | closed end 37 of base structure 35 |
| 38 | open end 38 of base structure 35 |
| 39 | top 39 of base structure 35 |

TABLE B-continued

| Reference numbers | |
|---|---|
| Ref # | Description |
| 40 | bottom 40 of base structure 35 |
| 41 | end tabs 41 of base structure 35 |
| 42 | gutter face plate 42 of base structure 35 |
| 43 | wall face plate of base structure 35 |
| 44 | attachment slot 44 of base structure 35 |
| 45 | cover structure 45 of water diverter 30 |
| 46 | sketch of prototype 46 of cover structure 45 |
| 47 | top 47 of cover 45 |
| 47A | rear channel 47A of top 47 |
| 48 | bottom 48 of cover 45 |
| 48A | rear channel 48A of bottom 48 |
| 49 | closed end 49 of cover 45 |
| 49A | rear channel 49A of the closed end 49 |
| 50 | means 50 for holding the cover 45 to base 35 such as spring clips, adhesive, plastic tabs, screws, threaded fasteners, metal fasteners, plastic fasteners, or the like spring clips |
| 51 | means 51 for holding the wall face of base structure 35 to wall abutment 65, the means such as adhesive, metal fasteners, plastic fasteners, screws, nails, threaded fasteners, and rigid drive clips, etc.) |
| 52 | reverse mold 52 to match siding 73 |
| 53 | optional end 53 to base structure 35 |
| 54 | optional end 54 to cover structure 45 |
| 55 | gutter 55 |
| 56 | raised rim section 56 for the base structure 35 |
| 60 | roof deck/shingles 60 |
| 65 | wall abutment 65 |
| 66 | fascia 66 |
| 70 | typical eaves and gutters 70 with masonry exterior 71 (brick, block, stucco, lick and stick face masonry, composite panels, etc.) |
| 71 | typical eaves 71 with siding exterior 73 (wood, vinyl, aluminum, cedar, shakes, composite materials, etc.) |
| 71A | photo/sketch 71A of typical eaves 71 with siding 73 |
| 72 | masonry exterior 72 |
| 73 | siding exterior 73 |
| 74 | stucco or flat board 74 |
| 81 | diverter 81 for water off roof 60 |
| 82 | downspout 82 from other roof portion 83 |
| 83 | other roof structure 83 |
| 90 | prior Art 90 U.S. Pat. No. 5,287,665 |
| 91 | prior Art 91 patent Application US2003/01311542 |
| 92 | prior Art 92 U.S. Pat. No. 7,685,779 |
| 93 | prior Art 93 U.S. Pat. No. 5,109,641 |

DETAILED DESCRIPTION OF PREFERRED EMBODIMENT

The present development is a special water diverter device for gutters. This invention relates to a special water diverter device for gutters at wall abutments. This invention relates to a gutter assembly for roofs and more particularly to a gutter or eaves trough assembly. The device relates generally to siding placed on a house, and more specifically to diverting rainwater from the juncture of a sloped roof and vertical wall siding. This is related to a two-piece device that encircles the gutter and helps prevent water intrusion behind a wall. It is for use at a juncture between a vertical wall and an edge of a sloped roof, to prevent water from seeping behind siding.

The advantages for the special water diverter device for gutters e 30 are listed above in the introduction. Succinctly the benefits are that the device:

A. Is fast to install;

B. Has most parts and molds already available with minor re-tooling;

C. Is a universal designs for attachments to fit different gutters and may be easily increased or decreased to fit the standard and seamless gutters;

D. Use by siding installers, gutter installers, repair persons, and masons;

E. Protects from water intrusion at vulnerable and traditionally difficult places to stop the intrusion; and F. Can be distributed by large building parts suppliers as well as box stores like Lowes, Menards, and Home Depot etc.

G. Yet another advantage of the present invention is that by diverting the water into a gutter positioned within the device, if ice should form, the ice will be contained within the device, thus preventing water and ice from backing up behind the siding or under the shingles.

The preferred embodiment of the water diverter device 30, made of durable materials, is for gutters 55 at wall abutments 30 and is comprised of: A water diverter device for gutters at wall abutments comprised of: (a) a base structure 35 including a top, bottom, closed end, open end, and a raised rim section 56 extending from a plate 42,43 with a gutter side and wall side; (b) a cover section 45 with a top, a bottom, a closed end and an open end; (c) a means 50 to hold cover 45 to rim 56 of base 35 such as spring clips, adhesive, plastic tabs, threaded fasteners, metal fasteners, plastic fasteners, or the like; and (d) an adhesive or fasteners 51 (screws, nails, rigid drive clips, etc.) to hold wall face plate 52,53 of base structure 35 to wall abutment 65 wherein the base structure is mounted to the wall abutment and the cove is placed and connected to the base structure which provides a sealed attached device for mounting the gutter to the fascia while also providing a seal for siding and masonry walls at the abutment.

There is shown in FIGS. 1-9 a complete description and operative embodiment of the water diverter device 30 for gutters 55 at wall abutments 65. In the drawings and illustrations, one notes well that the FIGS. 1-9 demonstrate the general configuration and use of this product. The various example uses are in the operation and use section, below. The accompanying drawings, which are incorporated in and constitute a part of this specification, illustrate an embodiment of the special water diverter device 30 for gutters 55 that is preferred. The drawings together with the summary description given above and a detailed description given below serve to explain the principles of the device 30. It is understood, however, that special water diverter device for gutters is not limited to only the precise arrangements and instrumentalities shown. Other examples of such devices are anticipated to be within the scope and spirit shown here.

FIGS. 1 A through 1 D are sketches of the general water diverter 30 for the gutters 55 at wall abutments 65. Shown are several of the parts and components which will be further detailed in this specification. Shown are: a special water diverter device 30 for gutters at wall abutments 65; a prototype 31 water diverter 30; a base structure 35 of water diverter 30; a prototype 36 of base structure 35; a cover structure 45 of water diverter 30; a prototype 46 of cover structure 45; a gutter 55; a roof deck/shingles 60; and a wall abutment 65.

FIGS. 2 A through 2 C are sketches of the general gutters 55 and eaves for masonry and siding applications. This helps set the stage for the use and significant improvements provided by the water diverter 30 for the gutters 55 at wall abutments 65. In these sketches are shown: a gutter 55; a roof deck/shingles 60; a wall abutment 65; a fascia 66; a sketch of a typical eaves and gutters 70 with masonry exterior 71 (brick, block, stucco, lick and stick face masonry, etc.); a sketch of a typical eaves 71 with siding exterior 73 (wood, vinyl, aluminum, cedar, shakes, composite materials, etc.); a photograph 71A of typical eaves 71 with siding 73; a masonry exterior 72; a siding exterior 73; and a stucco or flat board 74.

FIGS. 3 A through 3 E are sketches showing the problems addressed with gutters 55 at the wall abutments 65 with features shown from generally a side view. Shown here are the "patched on diverters" and gutters from other roof sections running down and flooding siding and wall abutments. Viewed in these photographic sketches are: a gutter 55; a roof deck/shingles 60; a wall abutment 65; a diverter 81 for water off roof 60; a downspout 82 from other roof portion 83; and another roof structure 83. The new water diverter 30 for the gutters 55 at wall abutments 65 solves these problems and shortfalls.

FIGS. 4 A through 4 C are sketches of the prototype water diverter 31, base 36, and cover 46 with components shown. Revealed in these component and features of the prototypes 36, 46 are: a prototype 31 water diverter 30; a prototype 36 of base structure 35; a closed end 37 of base structure 35; an open end 38 of base structure 35; a top 39 of base structure 35; a bottom 40 of base structure 35; an end tab 41 of base structure 35; a gutter face plate 42 of base structure 35; an attachment slot 44 of base structure 35; a prototype 46 of cover structure 45; a top 47 of cover 45; a rear channel 47A of top 47; a bottom 48 of cover 45; a rear channel 48A of bottom 48; a closed end 49 of cover 45; a rear channel 49A of the closed end 49; and a means 50 for holding the cover 45 to base 35 such as spring clips, adhesive, plastic tabs, screws, threaded fasteners, metal fasteners, plastic fasteners, or the like. The base structure 35 and cover 45 are made of durable materials. For example and not as a limitation: plastics, composite materials, metals—extruded, formed or cast—like aluminum, steel, steel alloy, copper, brass and other metals. These materials can also have a surface coating such as powder coat, paint or plating or naturally colored such as with plastics and composite materials.

FIGS. 5 A through 5 F are sketches of the prototype base 36 and prototype cover 46 with components and features denoted. These are more prototypes showing the components and features. Provided in these sketches are: a prototype 31 water diverter 30; a prototype 36 of base structure 35; a closed end 37 of base structure 35; an open end 38 of base structure 35; a top 39 of base structure 35; a bottom 40 of base structure 35; an end tab 41 of base structure 35; a gutter face plate 42 of base structure 35; a wall face plate of base structure 35; an attachment slot 44 of base structure 35; a cover structure 45 of water diverter 30; a prototype 46 of cover structure 45; a top 47 of cover 45; a rear channel 47A of top 47; a bottom 48 of cover 45; a rear channel 48A of bottom 48; a closed end 49 of cover 45; a rear channel 49A of the closed end 49; and a means 50 for holding the cover 45 to base 35 such as spring clips, adhesive, plastic tabs, screws, threaded fasteners, metal fasteners, plastic fasteners, or the like.

FIGS. 6 A through 6 I are black and white sketches of the water diverter 30, its base 35 and its cover 45 with components and features shown. These sketches show most of the parts and features of the water diverter device 30. Shown and demonstrated here are:

a special water diverter device 30 for gutters at wall abutments 65; a prototype 31 water diverter 30; a base structure 35 of water diverter 30; a closed end 37 of base structure 35; an open end 38 of base structure 35; a top 39 of base structure 35; a bottom 40 of base structure 35; an end tab 41 of base structure 35; a gutter face plate 42 of base structure 35; a wall face plate 43 of base structure 35; an attachment slot 44 of base structure 35; a cover structure 45 of water diverter 30; a rear channel 47A of top 47; a bottom 48 of cover 45; a rear channel 48A of bottom 48; a closed end 49 of cover 45; a rear channel 49A of the closed end 49; a means to hold 50 for holding the cover 45 to base 35 such as spring clips, adhesive, plastic tabs, screws, threaded fasteners, metal fasteners, plastic fasteners, or the like; and an adhesive or fasteners 51 for holding the wall face of base structure 35 to wall abutment 65, the means such as adhesive or fasteners 51 metal fasteners, plastic fasteners, screws, nails, threaded fasteners, and rigid drive clips (screws, nails, threaded fasteners, rigid drive clips, etc.).

FIGS. 7 A through 7 E are sketches of options for the water diverter base 30. In this view are seen the following components and features: a base structure 35 of water diverter 30; a prototype 36 of base structure 35; an end tab 41 of base structure 35; a gutter face plate 42 of base structure 35; a wall face plate of base structure 35; an attachment slot 44 of base structure 35; a cover structure 45 of water diverter 30; an adhesive or fasteners 51 for holding the wall face of base structure 35 to wall abutment 65, the means such as adhesive, metal fasteners, plastic fasteners, screws, nails, threaded fasteners, and rigid drive clips etc.); a reverse mold 52 to match siding 73; an optional end 53 to base structure 35; and an optional end 54 to cover structure 45.

FIGS. 8 A through 8 E are sketches of the water diverter 31 installation on a wall abutment 65 and roof deck 60. They are discussed below in the operation section.

FIGS. 9 A through 9 D are sketches of the prior art attempting to divert water from roofs at wall abutments. These include: prior Art 90 U.S. Pat. No. 5,287,665—Waterproof flanged exterior wall outlet secured to a building framework; prior Art 91 Patent Application US2003/01311542—Secondary moisture drainage system for structures having pre-manufactured exterior cladding systems; prior Art 92 U.S. Pat. No. 7,685,779—Molded wall flashing kick out; and prior Art 93 U.S. Pat. No. 5,109,641—Roof transition flashing.

The details mentioned here are exemplary and not limiting. Other specific components and manners specific to describing a special water diverter device 30 for gutters 55 may be added as a person having ordinary skill in the field of the art of gutters, siding and masonry devices for installation and their uses well appreciates.

Operation of the Preferred Embodiment

The water diverter device 30 for gutters 55 at wall abutments 65 has been described in the above embodiment. The manner of how the device operates is described below. One notes well that the description above and the operation described here must be taken together to fully illustrate the concept of the diverter device 30.

A special water diverter device 30 for gutters 55 at wall abutments 65 is simply installed. The prototype 36 of base structure 35 is attached to the wall abutment 65 by the rear face plate 43 and an adhesive or fasteners 51 for holding the wall face of base structure 35 to wall abutment 65, the means 51 adhesive, metal fasteners, plastic fasteners, screws, nails, threaded fasteners, and rigid drive clips, etc.). Next on the raised rim section 56 for the base structure 35, a means 50 for holding the cover 45 to base 35 (such as spring clips, adhesive, plastic tabs, screws, threaded fasteners, metal fasteners, plastic fasteners, or the like) is placed on the raised rim 56 and then the rear channel 47A of top 47; the rear channel 48A of bottom 48; and the rear channel 49A of the closed end 49 is "snapped or popped into place" over the connection means 50. After this, the gutter 55 is placed next to the gutter plate surface 52 of the base structure 35 (and cover 46) and then fastened as normal to the fascia 66 at the edge of the roof deck and shingles 60.

FIGS. 8 A through 8 E are sketches of the water diverter 31 installation on a wall abutment 65 and roof deck 60. Shown in these operational sketches are how the gutter 55 is nestled inside the prototype water diverted device 31. A prototype 36 of base structure 35; a prototype 46 of cover structure 45; a means 50 to hold cover 45 to base 35 such as spring clips, adhesive, plastic tabs, threaded fasteners, metal fasteners, plastic fasteners, or the like are not shown nor is the adhesive or fasteners 51 for holding the wall face of base structure 35 to wall abutment 65, the means 51 adhesive, metal fasteners, plastic fasteners, screws, nails, threaded fasteners, and rigid drive clips, etc.). In addition is shown the gutter 55; a roof deck/shingles 60; a wall abutment 65; and a fascia 66.

Many uses are anticipated for the water diverter device for gutters at wall abutments. Some examples, and not limitations, are shown in the following Table.

| ITEM | DESCRIPTION |
|---|---|
| 1 | Gutters with new siding installations (vinyl, aluminum, cedar, wood, etc.) |
| 2 | Gutters with new masonry installations (brick, block, stucco, lick and stick face masonry, etc.) |
| 3 | Replacement gutters with siding and flat walls |

With this description it is to be understood that the water diverter device 30 for gutters 55 at wall abutments 65 is not to be limited to only the disclosed embodiment of product. The features of the device 30 are intended to cover various modifications and equivalent arrangements included within the spirit and scope of the description.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

Unless defined otherwise, all technical and scientific terms used herein have the same meaning as commonly understood by one of ordinary skill in the art to which these inventions belong. Although any methods and materials similar or equivalent to those described herein can also be used in the practice or testing of the present inventions, the preferred methods and materials are now described above in the foregoing paragraphs.

Other embodiments of the invention are possible. Although the description above contains much specificity, these should not be construed as limiting the scope of the invention, but as merely providing illustrations of some of the presently preferred embodiments of this invention. It is also contemplated that various combinations or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

The terms recited in the claims should be given their ordinary and customary meaning as determined by reference to relevant entries (e.g., definition of "plane" as a carpenter's tool would not be relevant to the use of the term "plane" when used to refer to an airplane, etc.) in dictionaries (e.g., widely used general reference dictionaries and/or relevant technical dictionaries), commonly understood meanings by those in the art, etc., with the understanding that the broadest meaning imparted by any one or combination of these sources should be given to the claim terms (e.g., two or more relevant dictionary entries should be combined to provide the broadest meaning of the combination of entries, etc.) subject only to the following exceptions: (a) if a term is used herein in a manner more expansive than its ordinary and customary meaning, the term should be given its ordinary and customary meaning plus the additional expansive meaning, or (b) if a term has been explicitly defined to have a different meaning by reciting the term followed by the phrase "as used herein shall mean" or similar language (e.g., "herein this term means," "as defined herein," "for the purposes of this disclosure [the term] shall mean," etc.). References to specific examples, use of "i.e.," use of the word "invention," etc., are not meant to invoke exception (b) or otherwise restrict the scope of the recited claim terms. Other than situations where exception (b) applies, nothing contained herein should be considered a disclaimer or disavowal of claim scope. Accordingly, the subject matter recited in the claims is not coextensive with and should not be interpreted to be coextensive with any particular embodiment, feature, or combination of features shown herein. This is true even if only a single embodiment of the particular feature or combination of features is illustrated and described herein. Thus, the appended claims should be read to be given their broadest interpretation in view of the prior art and the ordinary meaning of the claim terms.

Unless otherwise indicated, all numbers or expressions, such as those expressing dimensions, physical characteristics, etc. used in the specification (other than the claims) are understood as modified in all instances by the term "approximately." At the very least, and not as an attempt to limit the application of the doctrine of equivalents to the claims, each numerical parameter recited in the specification or claims which is modified by the term "approximately" should at least be construed in light of the number of recited significant digits and by applying ordinary rounding techniques.

The present invention contemplates modifications as would occur to those skilled in the art. While the disclosure has been illustrated and described in detail in the figures and the foregoing description, the same is to be considered as illustrative and not restrictive in character, it being understood that only selected embodiments have been shown and described and that all changes, modifications and equivalents that come within the spirit of the disclosures described heretofore and or/defined by the following claims are desired to be protected.

What is claimed is:

1. A water diverter device 30 for gutters 55 at wall abutments 65 made of a durable material and comprised of:

(a) a base structure 35;

(b) a cover section 45 with a top, a bottom, a closed end and an open end opposite the closed end;

(c) a means 50 for holding the cover 45 to the base structure 35; and (d) a means 51 for holding a wall face plate 52, 53 of the base structure 35 to the wall abutment 65 wherein the base structure is mounted to the wall abutment and the cover is placed and connected to the base structure which provides a sealed and attached device for mounting eaves and gutters 70 to a fascia while also providing a seal for siding 73 and masonry 71 walls at the abutment.

2. The water diverter device 30 for gutters 55 at wall abutments 65 in claim 1 wherein the base structure 35 is further comprised of a top, bottom, closed end, open end, and a raised rim section 56 extending from a plate 42,43 with a gutter side and wall side.

3. The water diverter device 30 for gutters 55 at wall abutments 65 in claim 1 wherein the means 50 for holding the cover 45 to the base structure 35 is selected from a group consisting of spring clips, adhesive, plastic tabs, screws, threaded fasteners, metal fasteners, and plastic fasteners.

4. The water diverter device 30 for gutters 55 at wall abutments 65 in claim 1 wherein the means 51 for holding the wall face plate 52, 53 of the base structure 35 to the wall abutment 65 is selected from a group consisting of adhesive, metal fasteners, plastic fasteners, screws, nails, threaded fasteners, and rigid drive clips.

5. The water diverter device 30 for gutters 55 at wall abutments 65 in claim 1 wherein the masonry exterior 71 is selected from a group consisting of brick, block, stucco, lick and stick face masonry, and composite panels.

6. The water diverter device 30 for gutters 55 at wall abutments 65 in claim 1 wherein the siding exterior 73 is selected from a group consisting of wood, vinyl, aluminum, cedar, shakes, and composite materials.

7. The water diverter device in claim 1 wherein the durable material is selected from a group consisting of plastics, composite materials, form or cast metal, aluminum, steel, steel alloy, copper, and brass.

8. The water diverter device in claim 7 wherein the durable material is further comprised of a surface coating.

9. The water diverter device in claim 8 wherein the surface coating is selected from a group consisting of powder coat, paint, plating, and composite materials.

10. A water diverter device 30 for gutters 55 at wall abutments 65 made of a durable material and comprised of a base structure with a top, bottom, closed end, open end opposite the closed end, and a raised rim section extending from a plate with a gutter side and wall side; a cover section; a manner to hold the cover to the raised rim of the base structure; and an adhesive to hold a wall face plate of the base structure to the face of the wall abutment wherein the device is mounted to the wall abutment and the cover is placed and connected to the base structure which provides a sealed and attached device for mounting eaves and gutters 70 to the fascia while also providing a seal for siding 73 and masonry 71 walls at the wall abutment.

11. The water diverter device in claim 10 wherein the masonry exterior 71 is selected from a group consisting of brick, block, stucco, lick and stick face masonry, and composite panels.

12. The water diverter device in claim 10 wherein the siding exterior 73 is selected from a group consisting of wood, vinyl, aluminum, cedar, shakes, and composite materials.

13. The water diverter device in claim 10 wherein the durable material is selected from a group consisting of plastics, composite materials, form or cast metal, aluminum, steel, steel alloy, copper, and brass.

14. The water diverter device in claim 10 wherein the durable material is further comprised of a surface coating.

15. The water diverter device in claim 14 wherein the surface coating is selected from a group consisting of powder coat, paint, plating, and composite materials.

* * * * *